US006064411A

United States Patent [19]

van Sas et al.

[11] Patent Number: 6,064,411

[45] Date of Patent: May 16, 2000

[54] METHOD OF AND APPARATUS FOR FORMING A MULTI-COLOR IMAGE

[75] Inventors: Lambertus M. L. A. van Sas, Helmond; Herbert Morelissen, St. Tgelen; Johannes F. J. van Gageldonk, Venlo, all of Netherlands

[73] Assignee: Oce-Technologies B.V., Venlo, Netherlands

[21] Appl. No.: 08/928,641

[22] Filed: Sep. 12, 1997

[30] Foreign Application Priority Data

Sep. 13, 1996 [NL] Netherlands ..... 1004024

[51] Int. Cl.[7] ..... G03G 15/01

[52] U.S. Cl. ..... 347/115

[58] Field of Search ..... 347/115, 153, 347/155, 156, 262, 264, 175, 212, 213, 217; 399/239, 302, 320, 335; 430/42, 50; 428/411.1; 474/264, 271

[56] References Cited

U.S. PATENT DOCUMENTS 4,524,372 6/1985 De Cock et al. ..... 347/238

FOREIGN PATENT DOCUMENTS 9200713 4/1992 Netherlands .

*Primary Examiner*—N. Le
*Assistant Examiner*—Judy Nguyen

[57] ABSTRACT

A method of forming a multi-color image, wherein color separation images are generated at least two colors, and color separation images are formed by the use of colored toner powder and are transferred, in successive image-transfer steps under the influence of pressure, to an elastically deformable adhesive intermediate medium provided with a top layer, where the color separation images are collected to form a multi-color image, the method comprising softening the multi-color powder image and transferring it under pressure to a receiving support, wherein between two consecutive image transfer steps the powder image consisting of one or more color separation images is so deformed on the intermediate medium, under the influence of heat and/or pressure, that the powder image becomes adhesive for toner powder, subsequently transferring the color separation image not only to the intermediate medium but also to the powder image already present, wherein the intermediate medium comprises a heat-insulating layer in which the product of the thermal conductivity coefficient $\lambda$ in J/m sK, the density $\rho$ in kg/m$^3$ and the specific heat $C_p$ in J/kg K has a value of less than $2\times10^5$.

18 Claims, 2 Drawing Sheets

METHOD OF AND APPARATUS FOR FORMING A MULTI-COLOR IMAGE

BACKGROUND OF THE INVENTION

The present invention relates to a method of forming a multi-color image, wherein color separation images are generated in first, second, and possibly subsequent colors, which color separation images are formed by the use of colored toner powder. The color separation images are transferred, in successive image-transfer steps under the influence of pressure, to an elastically deformable adhesive intermediate medium provided with a top layer, and are collected thereon to form a multi-color image. The multi-color powder image is then softened and transferred under the influence of pressure to a receiving support, wherein between two consecutive image transfer steps the powder image consisting of one or more color separation images is so deformed on the intermediate medium, under the influence of heat and/or pressure, that the powder image becomes adhesive for toner powder, so that a subsequent color separation image can be transferred not only to the intermediate medium but also to the powder image already present. The present invention also relates to an apparatus suitable for performing the method according to the invention and to an intermediate belt usable in this apparatus for performing the method according to the invention. In this way it is possible to deposit transparent layers of toner powder in different colors on one another on the intermediate medium and obtain the required color shade via subtractive color mixing.

An apparatus suitable for performing this method is known from NL-A-92 00713.

This apparatus comprises four or more image recording elements, means for generating color separation images consisting of colored toner powder on the image recording elements, an intermediate medium provided with a surface covering of elastically deformable material for collecting the various color separation images thereon to form a multi-color image, and means for pressing against the intermediate medium in a transfer zone at least each image recording element on which the second and each following color separation image is formed.

In practice it has been found that there is in this known apparatus only a very small intermediate belt temperature gradient within which the apparatus operates reliably. If the temperature of the intermediate belt is too low, the toner powder is insufficiently softened, so that a subsequent powder image is not transferred sufficiently to the existing powder image. If the intermediate belt temperature is too high, the toner image from a first image recording element is deposited on a subsequent image support.

It has also been found that the image support gradually rises in temperature during operation of the apparatus so that the apparatus will operate unreliably during this time. The object of the present invention is to drastically reduce the above disadvantages. To this end, according to the present invention, the intermediate medium contains a heat-insulating layer in which the product of the thermal conductivity coefficient $\lambda$ in J/m sK, the density $\rho$ in kg/m$^3$ and the specific heat $C_p$ in J/kg K has a value of less than $2\times10^5$, and preferably less than $1.5\times10^5$. Advantageously, the product of the thermal conductivity coefficient, density and specific heat falls within the range of about $0.1\times10^5$ to less than $2\times10^5$.

As a result, a relatively low contact temperature is obtained between the image supports and the intermediate belt, and this enables toner images to be adhesively collected on a relatively hot intermediate belt without the image support becoming too hot, thus obviating toner particles from adhering firmly to the image support. The heat flow to the image supports is also reduced as a result, so that there is an energy saving. The reduced heat capacity with respect to the heat capacity of the intermediate belts also results in faster heating up of the intermediate belt during the heating operation. Consequently, the apparatus is ready to operate more quickly after starting.

Preferably, the heat-insulating layer is applied directly beneath the top layer in the form of an intermediate layer between the top layer and the base layer. This results in a small temperature gradient over the intermediate layer so that run/standby differences will occur to a reduced degree. Preferably, gas-filled fillers are used in the insulating layer. As a result the thermal conductivity in the belt is reduced to about 0.05–0.15 W/mK. In one embodiment, gas-filled glass beads are provided with a primer, thus giving better adhesion between the glass and the rubber. In order to further reduce the heat flow to the image support, a very short nip time is chosen in the image transfer step between the image support and the intermediate belt. This short nip time can be obtained by means of high speed during the image transfer and, as will be clear to the skilled man, by correct choice of the diameters of the image support and the intermediate belt in the image transfer zone.

BRIEF DESCRIPTION OF THE DRAWINGS

The invention will now be explained in detail with reference to the following description and accompanying drawings wherein.

Figure 1:
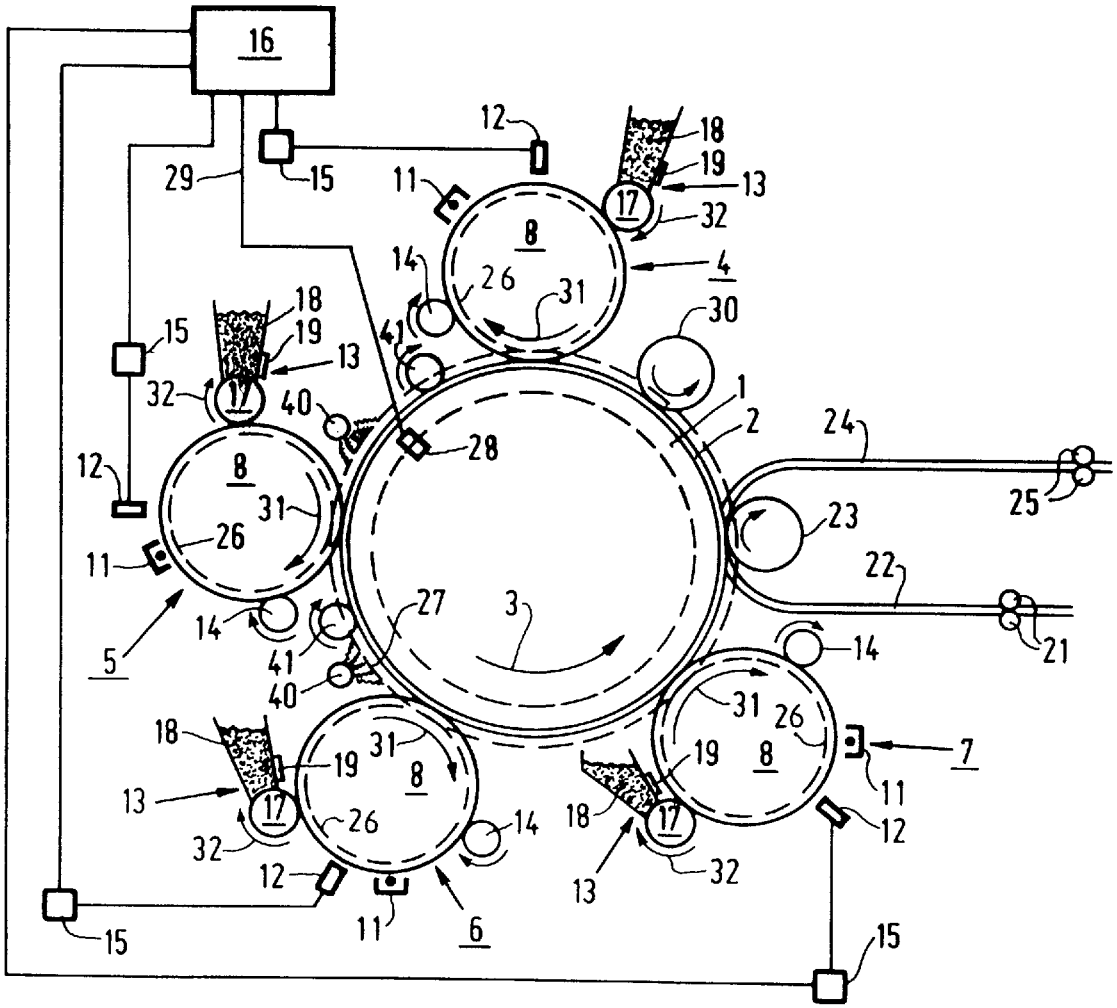
FIG. 1 is a diagrammatic illustration of a printing apparatus for performing the method according to the present invention.
Figure 2:
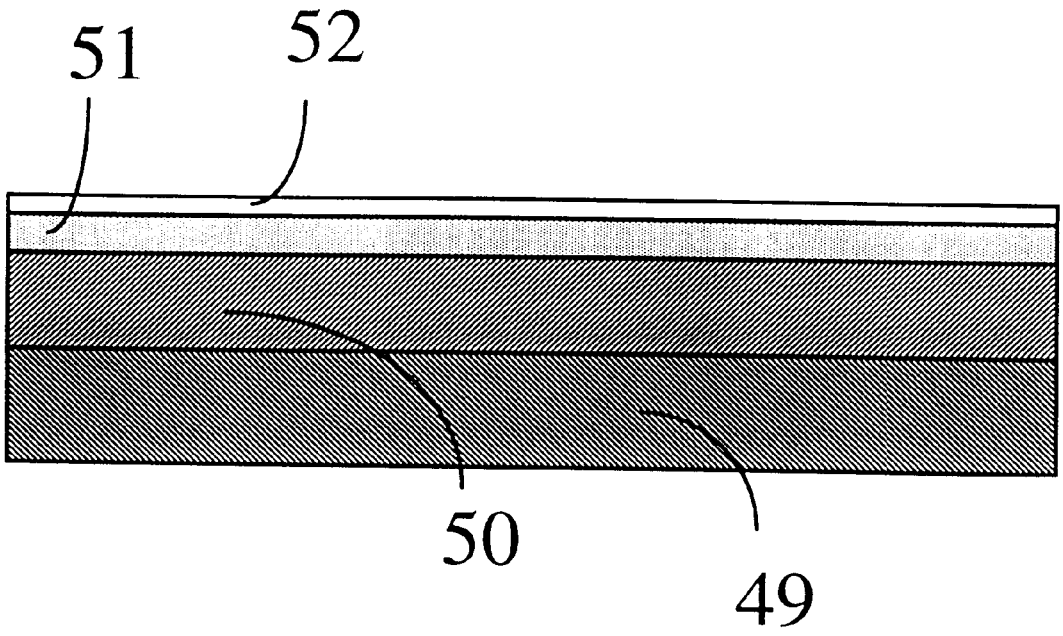
FIG. 2 is a diagram showing the layer structure of an intermediate belt which is usable in the method according to the present invention.

The printing apparatus shown in FIG. 1 comprises a cylindrical intermediate medium 1 drivable in the direction of arrow 3 by drive means (not shown). The intermediate medium 1 has a metal shell, e.g. of aluminium, and on this metal shell is disposed an outer covering having a structure as shown diagrammatically in FIG. 2, in which an underlay 50 of silicone rubber is disposed on the metal shell 49. A heat-insulating intermediate layer 51 containing air-filled glass beads is disposed on the underlay 50. A top layer 52 is disposed on the intermediate layer 51. Image forming stations 4, 5, 6 and 7 are disposed along the path of the intermediate medium 1. Each of these image forming stations comprises a cylindrical image recording element 8 on which a separation image is formed. The image recording elements 8 are all in pressure contact with the intermediate medium 1. Each image recording element 8 consists of a cylinder having a photo-conductive surface layer, the various image forming units being distributed along the periphery of the cylinder. The image forming units each comprise a coronan apparatus 11 for uniformly charging the photo-conductive layer, an LED array 12, with which the image-wise exposure is effected, a magnetic brush apparatus 13 to develop the resulting latent charge image to form a powder image, and a cleaning apparatus 14 for removing residual toner after transfer of the separation image to the intermediate medium 1.

The LED array 12, which is for example of the type described in U.S. Pat. No. 4,524,372, is connected to an electronic circuit 15 for energising each LED in the array in accordance with an information pattern for printing. The electronic circuit 15 of each image forming station is in turn connected to a central control unit 16, which feeds line by line to each electronic circuit 15 the information concerning the separation image for printing. The magnetic brush apparatus 13 comprises a magnetic roller 17, which is disposed a short distance from the periphery of the image recording element 8 and which consists of a rotatable shell with a magnetic system stationary therein. Disposed near the shell of each magnetic roller 17 is a reservoir 18 filled with electrically conductive, magnetically attractable toner powder. Each reservoir 18 contains a toner powder in a specific color. In the case illustrated here, the toner colors are successively magenta, cyan, yellow and black, the colored toner powders (apart from the black) being practically transparent. A wiper 19 is disposed at each reservoir 18 to ensure that an even layer of toner power is applied to the shell of the magnetic roller 17. Also disposed along the path of the intermediate medium 1 are feed means for introducing a sheet of image receiving material, said means consisting of co-operating transport rollers 21 and a guide 22, a pressure roller 23, and discharge means for the sheet of image receiving material, consisting of guide 24, transport rollers 25, and a cleaning apparatus 30. Each image recording element 8 is driven by a gearwheel 26 mounted on the axis of rotation of the image recording element 8 and engaging a gearwheel 27 fixed on the drive shaft of the intermediate medium 1. In the drawing, the gearwheels 26 and 27 are shown as broken circles, such circles indicating the pitch circles of the gearwheels.

A pulse transmitter 28 is connected to the intermediate medium 1 and delivers pulses relating to the angle of rotation of the intermediate medium 1. The angle of rotation between successive pulses corresponds to a displacement of the surface of the intermediate medium 1 over the width of one image line. The writing of the successive image lines on the image recording elements 8 by the LED arrays 12 can thus be controlled by the control unit 16 with reference to the pulses delivered by the pulse transmitter 28 and fed to the control unit 16 via the connection 29.

When the printing apparatus is operating, the intermediate medium 1, the image recording elements 8 and the magnetic rollers 17 are driven in the directions indicated by arrows 3, 31, and 32, respectively. In these conditions, the photoconductive layer of an image recording element 8, after being provided with a uniform electrostatic charge by the coronan apparatus 11, is exposed image-wise by the LED array 12, whereafter the latent charge image is developed by the magnetic brush apparatus 13 to form a separation image of colored toner powder. An image dot pattern of colored toner powder is formed on the image recording element 8 by selectively energising the LEDs in the array in accordance with an image pattern.

The information regarding the image lines of the various separation images which are required to be written is transferred line-by-line, serially by the control unit 16 to a shift register of the electronic circuits 15. On the subsequent receipt of the next pulse from the pulse transmitter 28, the information stored in the shift register of the first image forming station 4 is transferred to an output register and specific LEDs are energised via drivers in accordance with the image line for writing. In the meantime the shift register is filled with the information concerning the following image line. This image line is written on receipt of the next pulse from the pulse transmitter 28. The image forming means of the second image forming station 5 are also activated on receipt of a specific pulse from pulse transmitter 28, and, a number of pulses later, those of the next image forming station 6, and finally those of the image forming station 7 are activated. The number of pulses after which the image forming means of the second and subsequent image forming stations are activated is predetermined by the distance between the image forming stations disposed along the periphery of the intermediate medium 1.

The exact number of pulses is determined in a control program stored in the memory of the control unit 16. The separation images formed on the image recording elements 8 are transferred to the intermediate medium 1 in the various pressure-contact zones. The existing powder image consisting of one or, as the case may be, two color separation images is heated between the image forming stations 4 and 5 and also between the image forming stations 5 and 6 by means of a heat source 40, e.g. radiation or flashing from a halogen radiator. This heat supply causes the powder image on the intermediate medium 1 to be so softened that a subsequent separation image can also be deposited on the existing powder image. In this way it is possible to apply transparent layers one over the other in order to obtain a specific mixed color by subtractive color mixing. The multicolor image on the intermediate medium 1 is then heated in a known manner so that the powder image softens. The softened powder image is then transferred to an image receiving material, e.g. a sheet of paper, in the pressure zone between the intermediate medium 1 and the pressure roller 23, the image receiving material being supplied at the correct time via the feed means 21, 22. The printed image receiving material is discharged by the guide 24. The intermediate medium 1 then travels to the cleaning apparatus 30.

A heat source 40 is only necessary between the image forming stations 4 and 5, and 5 and 6, since only the separation images in the colors magenta, cyan, and yellow, formed respectively at the stations 4, 5, and 6, play any part in forming mixed colors. The separation image in the color black as formed in the image forming station 7 plays no part in this, so that it is not necessary to deposit the black separation image on previously formed separation images. The power required of the heat source 40 is determined by a number of factors, e.g. process speed and temperature setting of the image forming device, the toner material used, the heat source heat-transfer output, the distance between the heat source and the next image forming station, and so on. Depending on the selected configuration and materials, the skilled man can experimentally determine the correct power to achieve a softening of the powder image such that a following powder image can be transferred thereto by adhesion forces.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

EXAMPLE

In a printing apparatus as illustrated in the drawing a cylindrical intermediate medium 1 of a diameter of 180 mm is driven at a peripheral speed of 6 m/min. The intermediate medium 1 according to the construction of FIG. 2 has an aluminium shell 49 with an outer covering of silicone rubber thereon. The outer covering consists of a 1.8 mm thick base layer 50 of silicone rubber having a hardness of 51° Shore A, and over this is placed a 400 μm thick layer 51 of heat-insulating silicone rubber containing about 20% by volume of gas-filled glass beads mixed therein, the diameter of the glass beads being about 20 μm, and over this is placed an approximately 50 μm thick top layer 52 of silicone rubber having a hardness of 47° Shore A. The image recording elements 8 are pressed against the intermediate medium 1 with a force of 400 N per linear meter in the image forming stations 4, 5, 6, and 7. A halogen radiator 40 is disposed between the image forming stations 4 and 5, and 5 and 6 at a distance of about 50 mm (measured along the periphery of intermediate medium 1) from the contact zone between the intermediate medium 1 and the next image recording element 8 as considered in the drive direction. The colored toner powders used are produced by melting a thermoplastic resin in the form of an ICI Atlac type polyester resin, and distributing homogeneously in the melt, magnetically attractable material in the form of a carbonyl iron having a particle size of 1–3 μm, together with fine solid particles of carbon and dye particles.

The melt is then cooled to form a solid and processed to give toner powder particles having a particle size between 5 and 40 μm.

The intermediate medium 1 was set at a temperature of 95° C. (at the outer periphery of the intermediate medium 1) by means of an internal heating apparatus (not shown in detail) and a co-operating temperature control system.

It was found that each halogen radiator 40 had to be supplied with a power of 280 Watts in order to achieve a softening of the powder image consisting of one or more color separation images on the intermediate medium 1 such that the next color separation image was also transferred as completely as possible to the existing powder image.

However, as an alternative to the heat source 40 for achieving the required deformation of the powder image, it is possible to use a pressure means, e.g. in the form of a pressure roller 41. Deformation of the powder image can also be obtained by means of a combination of a heat source 40 and a pressure roller 41, or by flashing with a halogen lamp, for example.

This gives the skilled man the opportunity of embodying the required deformation power even at high processing speeds of the image forming apparatus, without having to apply exceptional pressures or heat energy powers.

Variants are possible for the above-described embodiment for performing the method according to the present invention. Depending upon the requirements that the image forming apparatus is required to satisfy with respect to color range—a complete range or a limited range—it is possible to use other colors of toner powders in the various image forming stations or else it is possible to use a combination of individual color separation images formed with transparent toner powders and individual color separation images formed with opaque (non-transparent) toner powders.

The above-illustrated embodiment of the image forming stations can also be replaced by one or more other image forming apparatus known in the prior art, e.g. based on a magnetographic, electrographic or electrophotographic processes, in which a latent magnetic or electrostatic image dot pattern is formed on an image recording medium and this image is developed with colored toner powder, or in which colored and possibly conductive toner powder is attracted, by selective energisation of image forming electrodes, in accordance with an image dot pattern, to a dielectric from a toner supply means which is in contact with the dielectric or at a short distance therefrom.

The intermediate medium can also be in the form of an endless belt. A 1.5 mm thick layer of peroxide-hardened silicone rubber or EPDM rubber is applied, for example, to a polyester fabric belt, e.g. of Nomex™. An approximately 400 μm thick layer of heat-insulating rubber is applied to this layer. Any materials suitable for the purpose can be selected for the heat-insulating layer, e.g. foam rubbers and plastics, gas-filled plastic beads and glass beads having a diameter of about 20 μm in a rubber such as silicone rubber, EPDM rubber, etc. A better connection to the rubber is obtained by priming the glass beads, the rigidity of the layer package being retained even under loading. A top layer of silicone rubber, for example, conventional as an intermediate layer, is applied to the intermediate layer.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of forming a multi-color image, which comprises, generating color separation images in at least two colors, said color separation images being formed by the use of colored toner powder;

transferring said color separation images in successive image-transfer steps, under pressure, to an elastically deformable adhesive intermediate medium provided with a top layer to form a multi-color image;

softening and transferring the multi-color powder image under pressure to a receiving support, wherein between two consecutive image transfer steps the powder image consisting of one or more color separation images is so deformed on the intermediate medium, under the influence of heat and/or pressure, that the powder image becomes adhesive for toner powder; and transferring a subsequent color separation image, not only to the intermediate medium, but also to the powder image already present, wherein the intermediate medium comprises a heat-insulating layer in which the product of the thermal conductivity coefficient $\lambda$ in J/m sK, the density $\rho$ in kg/m$^3$ and the specific heat $C_p$ in J/kg K has a value of less than $2\times10^5$.

2. The method according to claim 1, wherein the product of the thermal conductivity coefficient $\lambda$ in J/m sK, the density $\rho$ in kg/m$^3$ and the specific heat $C_p$ in J/kg K has a value less than $1.5\times10^5$.

3. The method according to claim 1, wherein the heat-insulating layer is disposed directly beneath the top layer in the form of an intermediate layer between the top layer and a base layer.

4. The method according to claim 3, wherein gas-filled fillers are used in the insulating layer.

5. The method according to claim 4, wherein the gas-filled fillers are glass filled gas beads.

6. The method according to claim 5, wherein the glass beads are provided with a primer layer.

7. The method of claim 1, wherein the product of the thermal conductivity, density, and specific heat of the heat-insulating layer is about $0.1\times10^5$ to less than $2\times10^5$.

8. An apparatus for forming a multi-color image which comprises:

a plurality of image recording elements, means for generating color separation images on the image recording elements, an intermediate medium provided with a surface covering of elastically deformable material for collecting the color separation images thereon to form a multi-color image, and means for pressing the image recording elements against the intermediate medium for transferring, in sequence, the color separation images onto the intermediate medium, wherein the intermediate medium contains a heat-insulating layer in which the product of the thermal conductivity coefficient $\lambda$ in J/m sK, the density $\rho$ in kg/m$^3$ and the specific heat $C_p$ in J/kg K has a value of less than $2\times10^5$.

9. The apparatus of claim 8, wherein the product of the thermal conductivity density and specific heat of the heat-insulating layer is about $0.1\times10^5$ to less than $2\times10^5$.

10. The apparatus of claim 8, wherein means are provided for transferring the final color image to an image receiving material.

11. The apparatus of claim 8, wherein the intermediate medium comprises a top layer, said heat-insulating intermediate layer, and a base layer.

12. The apparatus of claim 11, wherein the heat insulating intermediate layer contains gas-filled fillers which reduces the thermal conductivity of the intermediate medium to about 0.05 to 0.15 W/mK.

13. The apparatus of claim 11, wherein the top layer, the heat-insulating intermediate layer, and the base layer contain silicon rubber.

14. An intermediate medium for collecting color separation images to form a multi-color image thereon, said intermediate medium having a surface covering of elastically deformable material contains a heat-insulating layer in which the product of the thermal conductivity coefficient $\lambda$ in J/m sK, the density $\rho$ in kg/m$^3$ and the specific heat $C_p$ in J/kg K has a value of less than $2\times10^5$.

15. The intermediate medium of claim 14, wherein the intermediate medium comprises a top layer, said heat-insulating intermediate layer, and a base layer.

16. The intermediate medium of claim 15, wherein the heat insulating intermediate layer contains gas-filled fillers which reduces the thermal conductivity of the intermediate medium to about 0.05 to 0.15 W/mK.

17. The intermediate medium of claim 15, wherein the top layer, the heat-insulating intermediate layer, and the base layer contain silicon rubber.

18. The intermediate medium of claim 14, having a cylindrical configuration.

* * * * *